US009732301B2

(12) United States Patent
Watts et al.

(10) Patent No.: US 9,732,301 B2
(45) Date of Patent: Aug. 15, 2017

(54) POWER TRANSMITTING FLUIDS WITH IMPROVED MATERIALS COMPATIBILITY

(71) Applicant: Infineum International Limited, Abingdon (GB)

(72) Inventors: Raymond F. Watts, Long Valley, NJ (US); Keith R. Gorda, Little York, NJ (US)

(73) Assignee: INFINEUM INTERNATIONAL LIMITED, Abingdon, Oxfordshire (GB)

( * ) Notice: Subject to any disclaimer, the term of this patent is extended or adjusted under 35 U.S.C. 154(b) by 242 days.

(21) Appl. No.: 14/533,195

(22) Filed: Nov. 5, 2014

(65) Prior Publication Data

US 2016/0122680 A1 May 5, 2016

(51) Int. Cl.
*C10M 139/00* (2006.01)
*C10M 161/00* (2006.01)
*C10M 141/10* (2006.01)

(52) U.S. Cl.
CPC ..... *C10M 161/00* (2013.01); *C10M 141/10* (2013.01); *C10M 2203/1006* (2013.01); *C10M 2207/026* (2013.01); *C10M 2209/084* (2013.01); *C10M 2209/104* (2013.01); *C10M 2209/109* (2013.01); *C10M 2215/042* (2013.01); *C10M 2215/064* (2013.01); *C10M 2215/223* (2013.01); *C10M 2215/28* (2013.01); *C10M 2219/044* (2013.01); *C10M 2219/046* (2013.01); *C10M 2223/049* (2013.01); *C10N 2230/10* (2013.01); *C10N 2230/14* (2013.01); *C10N 2230/36* (2013.01); *C10N 2240/04* (2013.01); *C10N 2240/042* (2013.01); *C10N 2260/14* (2013.01)

(58) Field of Classification Search
CPC ..... C10M 2227/061; C10M 2227/062
USPC ..... 508/198
See application file for complete search history.

(56) References Cited

U.S. PATENT DOCUMENTS

| | | | | |
|---|---|---|---|---|
| 2,719,125 | A | 9/1955 | Roberts | |
| 2,719,126 | A | 9/1955 | Fields | |
| 2,760,933 | A | 8/1956 | Fields | |
| 2,836,564 | A | 5/1958 | Roberts | |
| 3,087,937 | A | 4/1963 | Tesi et al. | |
| 3,254,025 | A | 5/1966 | Le Suer | |
| 3,502,677 | A | 3/1970 | Le Suer | |
| 3,663,561 | A | 5/1972 | Blaha | |
| 4,857,214 | A | 8/1989 | Papay et al. | |
| 4,873,009 | A | 10/1989 | Anderson | |
| 5,105,571 | A | 4/1992 | Kinchin et al. | |
| 5,185,090 | A | 2/1993 | Ryer et al. | |
| 5,242,612 | A | 9/1993 | Ryer et al. | |
| 2004/0010967 | A1* | 1/2004 | Aradi | C07C 217/08 44/403 |
| 2005/0250655 | A1* | 11/2005 | Adams | C10M 141/06 508/287 |
| 2010/0286009 | A1* | 11/2010 | Vierbaum | C10M 173/025 508/431 |
| 2011/0218128 | A1* | 9/2011 | Hishinuma | C10M 169/02 508/181 |

* cited by examiner

*Primary Examiner* — Vishal Vasisth
(74) *Attorney, Agent, or Firm* — Andrews Kurth Kenyon LLP

(57) ABSTRACT

A power transmitting fluid comprises a major amount of a lubricating oil and a minor amount of an additive composition. The additive composition comprises:
(a) a friction modifier of the formula:

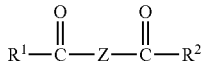

(b) an oil-soluble phosphorus compound; and,
(c) an ashless dispersant;
wherein $R^1$ and $R^2$ may be the same or different and represent linear or branched, saturated or unsaturated hydrocarbyl groups having from 8 to 20 carbon atoms. Z represents a polyoxyalkylene segment or a polyalkoxylated alkyl amine segment. The friction modifiers provide the fluid with improved fluoroelastomer seal compatibility and enhanced copper corrosion compatibility.

10 Claims, No Drawings

POWER TRANSMITTING FLUIDS WITH IMPROVED MATERIALS COMPATIBILITY

This invention relates to a composition and a method of improving the materials compatibility of power transmitting fluids, particularly, automatic transmission fluids (ATFs).

The continuing search for improved overall reliability and freedom from maintenance means that lubricants used within vehicles, such as engine oils, transmission fluids, differential oils and the like, all need to be capable of meeting their lubrication requirements for longer and longer periods of time. While the practice with engine oils still remains to have a reasonable drain interval, e.g. 5,000 or 7,500 miles, the trend for transmission fluids and differential oils is to have them be 'fill-for-life' which is commonly defined as more than 100,000 miles, frequently more than 150,000 miles of vehicle operation. This means that not only do such lubricants have to be able to provide their basic lubrication function of controlling friction, wear, oxidation, corrosion etc., for very extended periods, they also have to be, and remain, compatible with materials they come into contact with in the vehicle. Among the most critical in this respect are the elastomeric materials commonly used as oil seals in vehicle systems.

In the past, oil seals were made from materials such as nitrilic rubbers and their hydrogenated analogues, acrylates and vinyl-modified acrylic polymers. Lubricants were provided with seal swelling agents such as phthalate esters, sulfolane derivatives and naphthenic oils to swell and soften the oil seals thereby ensuring effective operation. Due to the trend for improved vehicle lifetime and lower maintenance requirements outlined above, many transmission builders have moved to using oil seals manufactured from more chemically inert elastomers. Of these, the fluoropolymers often designated "FKM" seals or sold under the trade mark Viton® are among the most preferred.

Although fluoropolymer seals have many advantageous properties, one common problem is that they are susceptible to de-polymerisation when in contact with certain amine compounds or compounds with amine functionality. Unfortunately, many useful lubricant additives, including useful friction modifiers for automatic transmission fluids, contain amine functionality and so can cause, or contribute to, de-polymerisation or cross-linking of fluoropolymer seals. There is then a need to provide lubricant additives which are less aggressive towards fluoropolymer materials. This invention provides lubricant formulations containing a type of friction modifier additive which displays much improved compatibility with fluoropolymer seals.

Additionally in modern transmissions, the transmission fluid often has exposure to copper-containing arts. These parts can be mechanical parts such as bushings or they can be electrical parts such as servo motors and solenoids, or they can be circuit boards. In all cases the lubricant must be compatible with these parts, not causing corrosion or dissolution of the copper. The friction modifiers used in this invention provide better copper compatibility than analogous friction modifiers based on nitrogen-containing moieties.

Accordingly in a first aspect, the present invention provides a power transmitting fluid comprising a major amount of a lubricating oil and a minor amount of an additive composition, the additive composition comprising:

(a) a friction modifier of the formula:

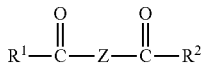

(b) an oil-soluble phosphorus compound; and, (c) an ashless dispersant;

wherein $R^1$ and $R^2$ may be the same or different and represent linear or branched, saturated or unsaturated hydrocarbyl groups having from 8 to 20 carbon atoms; and wherein Z represents a polyoxyalkylene segment or a polyalkoxylated alkyl amine segment.

In a preferred embodiment, the friction modifier (a) has the structure:

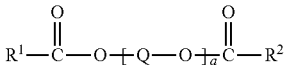

wherein Q represents an alkylene group having 1 to 4 carbon atoms, and wherein a is an integer from 5 to 15.

In another preferred embodiment, the friction modifier (a) has the structure:

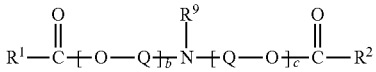

wherein each Q independently represents an alkylene group having 1 to 4 carbon atoms; wherein b and c are independently an integer from 1 to 6, and wherein $R^9$ represents linear or branched, saturated or unsaturated hydrocarbyl group having from 4 to 20 carbon atoms.

For both preferred embodiments, preferably Q or each Q is an ethylene group ($—CH_2—CH_2—$).

Preferably $R^9$ is an alkyl group. More preferably $R^9$ is a linear alkyl group.

For both preferred embodiments, preferably $R^1$ and $R^2$ are alkyl groups and more preferably they are the same. Preferably, $R^1$ and $R^2$ are both linear or branched, saturated or unsaturated alkyl groups having from 8 to 20 carbon atoms.

The preferred friction modifiers are conveniently made by reacting long-chain carboxylic acids such as oleic acid, stearic acid, hexadecanoic acid, isostearic acid and lauric acid with polyalkylene, preferably polyethylene glycols (PEG). Preferred are PEG with molecular weights between 200 and 800, most preferably around 400. Alternatively, polyalkoxylated alkyl amines can be used in place of PEG. Suitable materials include those sold under the 'ETHOMEEN®' trade name which are available from Akzo Nobel. The preferred polyalkoxylated alkyl amines are those made from amines with hydrocarbon groups of from 12 to 20 carbon atoms and which have been reacted with from 2 to 12 moles of alkylene oxide, preferably ethylene oxide, per nitrogen atom.

The friction modifiers (a) can be used in any effective amount however they are preferably used in amounts from about 0.1 to 10.0% by mass based on the mass of the fluid, preferably from 0.25 to 7.0% by mass, most preferably from 0.5 to 5.0 mass %.

As used in this specification the term "hydrocarbyl" refers to a group having a carbon atom directly attached to the rest of the molecule and having a hydrocarbon or predominantly hydrocarbon character. Non-hydrocarbon (hetero) atoms, groups or substituents may be present provided their presence does not alter the predominantly hydrocarbon nature of the group. Examples of hetero atoms include O, S and N and examples of hetero atom-containing groups or substituents include amine, keto, halo, hydroxy, nitro, cyano, alkoxy and acyl. Preferred are hydrocarbyl groups which contain at most one or two hetero atoms, groups or substituents. More preferred are purely hydrocarbon groups and most preferred are aliphatic groups, i.e. alkyl groups or alkenyl groups.

The oil-soluble phosphorus compound (b) may be any suitable type, and may be a mixture of different compounds. Typically such compounds are used to provide anti-wear protection. The only limitation is that the material be oil-soluble so as to permit its dispersion and transport within the lubricating oil to its site of action. Examples of suitable phosphorus compounds are: phosphites and thiophosphites (mono-alkyl, di-alkyl, tri-alkyl and hydrolyzed or partially hydrolyzed analogues thereof); phosphates and thiophosphates; amines treated with inorganic phosphorus compounds such as phosphorus acid, phosphoric acid or their thio-analogues; zinc dithiophosphates (ZDDP); amine phosphates. Examples of particularly suitable phosphorus compounds include the mono-, di- and tri-alkyl phosphites represented by the structures:

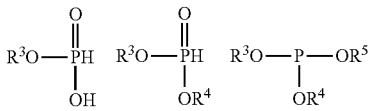

and the tri-alkyl phosphate represented by the structure:

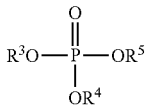

wherein groups $R^3$, $R^4$ and $R^5$ may be the same or different and may be hydrocarbyl groups as defined hereinabove or aryl groups such as phenyl or substituted phenyl. Additionally or alternatively, one or more of the oxygen atoms in the above structures may be replaced by a sulphur atom to provide other suitable phosphorus compounds.

In preferred embodiments groups $R^3$ and $R^4$ and $R^5$ (when present) are linear alkyl groups such as butyl, octyl, decyl, dodecyl, tetradecyl and octadecyl and particularly the corresponding groups containing a thioether linkage. Branched groups are also suitable. Non-limiting examples of component (b) include di-butyl phosphite, tri-butyl phosphite, di-2-ethylhexyl phosphite, tri-lauryl phosphite and tri-lauryl-tri-thio phosphite and the corresponding phosphites where the groups $R^3$ and $R^4$ and $R^5$ (when present) are 3-thio-heptyl, 3-thio-nonyl, 3-thio-undecyl, 3-thio-tridecyl, 5-thio-hexadecyl and 8-thio-octadecyl. The most preferred alkyl-phosphites for use as component (b) are those described in U.S. Pat. Nos. 5,185,090 and 5,242,612, which are hereby incorporated by reference.

While any effective amount of the oil-soluble phosphorus compound may be used, typically the amount used will be such as to provide the power transmitting fluid with from 10 to 1000, preferably from 100 to 750, more preferably from 200 to 500 part per million by mass (ppm) of elemental phosphorus, per mass of the fluid.

Suitable as the ashless dispersant (c) are hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also suitable are condensation products of polyamines and hydrocarbyl-substituted phenyl acids. Mixtures of these dispersants can also be used.

Basic nitrogen-containing ashless dispersants are well-known lubricating oil additives and methods for their preparation are extensively described in the patent literature. Preferred dispersants are the alkenyl succinimides and succinamides where the alkenyl-substituent is a long-chain of preferably greater than 40 carbon atoms. These materials are readily made by reacting a hydrocarbyl-substituted dicarboxylic acid material with a molecule containing amine functionality. Examples of suitable amines are polyamines such as polyalkylene polyamines, hydroxy-substituted polyamines and polyoxyalkylene polyamines. Preferred are polyalkylene polyamines such as diethylene triamine, triethylene tetramine, tetraethylene pentamine and pentaethylene hexamine. Low cost polyethylene polyamines (PAMs) which are mixtures having on average 5 to 7 nitrogen atoms per molecule are commercially available under trade names such as "Polyamine H", "Polyamine 400", "Dow Polyamine E-100 " and others. Mixtures where the average number of nitrogen atoms per molecule is greater the 7 are also available. These are commonly called heavy polyamines or H-PAMs. Examples of hydroxy-substituted polyamines include N-hydroxyalkyl-alkylene polyamines such as N-(2-hydroxyethyl)ethylene diamine, N-(2-hydroxyethyl)piperazine, and N-hydroxyalkylated alkylene diamines of the type described in U.S. Pat. No. 4,873,009. Examples of polyoxyalkylene polyamines typically include polyoxyethylene and polyoxypropylene diamines and triamines having average molecular weights in the range of 200 to 2,500. Products of this type are available under the Jeffamine trade mark.

As is known in the art, reaction of the amine with the hydrocarbyl-substituted dicarboxylic acid material (suitably an alkenyl succinic anhydride or maleic anhydride) is conveniently achieved by heating the reactants together in an oil solution. Reaction temperatures of 100 to 250° C. and reaction times of 1 to 10 hours are typical. Reaction ratios can vary considerably but generally from 0.1 to 1.0 equivalents of dicarboxylic acid unit content is used per reactive equivalent of the amine-containing reactant.

Particularly preferred ashless dispersants are the polyisobutenyl succinimides formed from polyisobutenyl succinic anhydride and a polyalkylene polyamine such as triethylene tetramine or tetraethylene pentamine. The polyisobutenyl group is derived from polyisobutene and preferably has a number average molecular weight (Mn) in the range 1,500 to 5,000, for example 1,800 to 3,000. As is known in the art, the dispersants may be post treated (e.g. with a boronating agent or an inorganic acid of phosphorus). Suitable examples are given in U.S. Pat. Nos. 3,254,025, 3,502,677 and 4,857,214.

The ashless dispersants (c) can be used in any effective amount however they are typically used in amounts from about 0.1 to 10.0% by mass based on the mass of the fluid, preferably from 0.5 to 7.0% by mass, most preferably from 2.0 to 5.0 mass %.

In a preferred embodiment, the power transmitting fluid of the present invention further comprises one or more corrosion inhibitor. These are used to reduce the corrosion of metals such as copper and are often alternatively referred to as metal deactivators or metal passivators. Suitable corrosion inhibitors are nitrogen and/or sulfur containing heterocyclic compounds such as triazoles (e.g. benzotriazoles), substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof. Preferred corrosion inhibitors are of the two types represented by the structures:

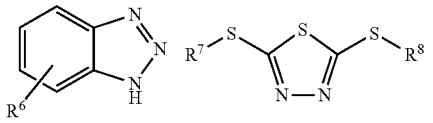

The benzotriazoles useful in this invention are shown in the left-hand structure above where $R^6$ is absent or a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O or S. Examples of suitable compounds are benzotriazole, alkyl-substituted benzotriazoles (e.g. tolyltriazole, ethylbenzotriazole, hexylbenzotriazole, octylbenzotriazole, etc.), aryl substituted benzotriazole and alkylaryl- or arylalkyl-substituted benzotriazoles. Preferably, the triazole is a benzotriazole or an alkylbenzotriazole in which the alkyl group contains from 1 to about 20 carbon atoms, preferably 1 to about 8 carbon atoms. Benzotriazole and tolyltriazole are particularly preferred.

The substituted thiadiazoles useful in the present invention are shown in the right-hand structure above and derived from the 2,5-dimercapto-1,3,4-thiadiazole (DMTD) molecule. Many derivatives of DMTD have been described in the art, and any such compounds can be included in the fluids of the present invention. The preparation of DMTD derivatives has been described in E. K. Fields "Industrial and Engineering Chemistry", 49, p. 1361-4 (September 1957).

U.S. Pat. Nos. 2,719,125, 2,719,126 and 3,087,937 describe the preparation of various 2,5-bis-(hydrocarbon dithio)-1,3,4-thiadiazoles. The hydrocarbon group may be aliphatic or aromatic, including cyclic, alicyclic, aralkyl, aryl and alkaryl.

Also useful are other derivatives of DMTD. These include the carboxylic esters wherein $R^7$ and $R^8$ are joined to the sulfide sulfur atom through a carbonyl group. Preparation of these thioester containing DMTD derivatives is described in U.S. Pat. No. 2,760,933. DMTD derivatives produced by condensation of DMTD with alpha-halogenated aliphatic monocarboxylic carboxylic acids having at least 10 carbon atoms is described in U.S. Pat. No. 2,836,564. This process produces DMTD derivatives wherein $R^7$ and $R^8$ are HOOC—CH(R')— (R' being a hydrocarbyl group). DMTD derivatives further produced by amidation or esterification of these terminal carboxylic acid groups are also useful.

The preparation of 2-hydrocarbyldithio-5-mercapto-1,3,4-thiadiazoles characterized by the structure above, wherein $R^7$=R'—S— and $R^8$=H is described in U.S. Pat. No. 3,663,561. The compounds are prepared by the oxidative coupling of equimolar portions of a hydrocarbyl mercaptan and DMTD or its alkali metal mercaptide. The compositions are reported to be excellent in preventing copper corrosion. The mono-mercaptans used in the preparation of the compounds are represented by the formula:

R'SH wherein R' is a hydrocarbyl group containing from 1 to about 250 carbon atoms. A peroxy compound, hypohalide or air, or mixtures thereof can be utilized to promote the oxidative coupling. Specific examples of the mono-mercaptan include, for example, methyl mercaptan, isopropyl mercaptan, hexyl mercaptan, octyl mercaptan, decyl mercaptan and long chain alkyl mercaptans.

A preferred class of DMTD derivatives are the mixtures of the 2-hydrocarbyldithio-5-mercapto-1,3,4-thiadiazoles and the 2,5-bis-hydrocarbyldithio-1,3,4-thiadiazoles. These mixtures are prepared as described above except that more than one, but less than two, mole of alkyl mercaptan are used per mole of DMTD. Such mixtures are sold under the trade name Hitec 4313.

Corrosion inhibitors can be used in any effective amount however they are typically used in amounts from about 0.001 to 5.0% by mass based on the mass of the fluid, preferably from 0.005 to 3.0% by mass, most preferably from 0.01 to 1.0 mass %.

In a preferred embodiment, the power transmitting fluid of the present invention further comprises one or more metal-containing detergents. These are well known in the art and are exemplified by oil-soluble neutral or overbased salts of alkali or alkaline earth metals with one or more of the following acidic substances (or mixtures thereof): (1) sulfonic acids, (2) carboxylic acids, (3) salicylic acids, (4) alkyl phenols, (5) sulfurized alkyl phenols. The preferred salts of such acids from the cost-effectiveness, toxicological, and environmental standpoints are the salts of sodium, potassium, lithium, calcium and magnesium.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts.

The term "overbased" in connection with metallic detergents is used to designate metal salts wherein the metal is present in stoichiometrically larger amounts than the organic radical. The commonly employed methods for preparing the over-based salts involve heating a mineral oil solution of an acid with a stoichiometric excess of a metal neutralizing agent such as the metal oxide, hydroxide, carbonate, bicarbonate, of sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60 to 200° C.

Examples of suitable metal-containing detergents include, but are not limited to, neutral and overbased salts of such substances as lithium phenates, sodium phenates, potassium phenates, calcium phenates, magnesium phenates, sulfurized lithium phenates, sulfurized sodium phenates, sulfurized potassium phenates, sulfurized calcium phenates, and sulfurized magnesium phenates wherein each aromatic group has one or more aliphatic groups to impart hydrocarbon solubility; lithium sulfonates, sodium sulfonates, potassium sulfonates, calcium sulfonates, and magnesium sulfonates wherein each sulfonic acid moiety is attached to an aromatic nucleus which in turn usually contains one or more aliphatic substituents to impart hydrocarbon solubility; lithium salicylates, sodium salicylates, potassium salicylates, calcium salicylates and magnesium salicylates wherein the aromatic moiety is usually substituted by one or more aliphatic substituents to impart hydrocarbon solubility; the lithium, sodium, potassium, calcium and magnesium salts of hydrolyzed phosphosulfurized olefins having 10 to 2,000 carbon atoms or of hydrolyzed phosphosulfurized alcohols and/or aliphatic-substituted phenolic compounds having 10 to 2,000 carbon atoms; lithium, sodium, potassium, calcium and magnesium salts of aliphatic carboxylic acids and aliphatic substituted cycloaliphatic carboxylic acids; and many other similar alkali and alkaline earth metal salts of oil-soluble organic acids. Mixtures of neutral or over-based salts of two or more different alkali and/or alkaline earth metals can be used. Likewise, neutral and/or overbased salts of mixtures of two or more different acids (e.g. one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Collectively, the various metallic detergents referred to herein above, have sometimes been called, simply, neutral, basic or overbased alkali metal or alkaline earth metal-containing organic acid salts.

Methods for the production of oil-soluble neutral and overbased metallic detergents and alkaline earth metal-containing detergents are well known to those skilled in the art, and extensively reported in the patent literature.

The metal-containing detergents utilized in this invention can, if desired, be oil-soluble boronated neutral and/or overbased alkali of alkaline earth metal-containing detergents. Methods for preparing boronated metallic detergents are well known to those skilled in the art, and extensively reported in the patent literature.

Preferred metallic detergents for use with this invention are overbased sulfurized calcium phenates, overbased calcium sulfonates, and overbased calcium salicylates.

Metal-containing detergents can be used in any effective amount however they are typically used in amounts from about 0.01 to 2.0% by mass based on the mass of the fluid, preferably from 0.05 to 1.0% by mass, most preferably from 0.05 to 0.5 mass %.

Other additives known in the art may be added to the power transmitting fluids of this invention. These include other anti-wear agents, extreme pressure additives, anti-oxidants, viscosity modifiers and the like. They are typically disclosed in, for example, "Lubricant Additives" by C. V. Smallheer and R. Kennedy Smith, 1967, pp 1-11 and in U.S. Pat. No. 5,105,571.

Components (a), (b) and (c) together with other desired additives may be combined to form a concentrate. Typically the active ingredient (a.i.) level of the concentrate will range from 20 to 90 wt % of the concentrate, preferably from 25 to 80 wt %, for example 35 to 75 wt %. The balance of the concentrate is a diluent. Lubricating oils or compatible solvents form suitable diluents.

Lubricating oils useful to form the fluids of the present invention may be of any commonly used type. These include natural lubricating oils, synthetic lubricating oils, and mixtures thereof.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have kinematic viscosities of from 2.0 $mm^2/s$ (cSt) to 8.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly(1-octenes), poly-(1-decenes), etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1,000, diphenyl ether of polypropylene glycol having a molecular weight of 1,000-1,500); and mono- and poly-carboxylic esters thereof (e.g., the acetic acid esters, mixed $C_3$-$C_8$ fatty acid esters, and $C_{12}$ oxo-acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl)silicate, tetra-(4-methyl-2-ethylhexyl)silicate, tetra-(p-tert-butylphenyl)silicate, hexa-(4-methyl-2-pentoxy)-disiloxane, poly(methyl)-siloxanes and poly(methylphenyl)siloxanes, and the like. Other synthetic lubricating oils include liquid esters of phosphorus-containing acids (e.g., tricresyl phosphate, trioctyl phosphate, and diethyl ester of decylphosphonic acid), polymeric tetra-hydrofurans, poly-α-olefins, and the like.

The lubricating oils may be derived from refined, re-refined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydro treating, dewaxing, solvent extraction, acid or base extraction, filtration, and percolation, all of which are known to those skilled in the art. Re-refined oils are obtained by treating used oils in processes similar to those used to obtain the refined oils. These re-refined oils are also known as reclaimed or reprocessed oils and are often additionally processed by techniques for removal of spent additives and oil breakdown products.

Lubricating oils derived from natural gas by a process such as the Fischer-Tropsch reaction, sometimes referred to as Gas-to-Liquid (GTL) basestocks are also useful in this invention.

When the lubricating oil is a mixture of natural and synthetic lubricating oils (i.e., partially synthetic), the choice of the partial synthetic oil components may widely vary, however, particularly useful combinations are comprised of mineral oils and poly-α-olefins (PAO), particularly oligomers of 1-decene.

In a preferred embodiment, the power transmitting fluid is an automatic transmission fluid, a continuously variable transmission fluid or a fluid for a dual clutch transmission. The fluids of the present invention may also find use as gear oils, hydraulic fluids, industrial oils, power steering fluids, pump oils, tractor fluids or similar.

In accordance with a second aspect, the present invention provides a method of formulating a power transmitting fluid with improved fluoroelastomer seal compatibility, the method comprising combining a major amount of a lubricating oil with a minor amount of an additive composition as defined in relation to the first aspect.

In accordance with a third aspect, the present invention provides a method of formulating a power transmitting fluid with improved copper corrosion compatibility, the method comprising combining a major amount of a lubricating oil with a minor amount of an additive composition as defined in relation to the first aspect.

In other aspects, the present invention provides the use of an additive composition as defined in relation to the first aspect to improve the fluoroelastomer seal compatibility and/or the copper corrosion compatibility of a power transmitting fluid.

Methods for determining an improvement in fluoroelastomer seal compatibility will be known to those skilled in the art. For example, samples of fluoroelastomer material commonly used to manufacture seals for use in vehicle transmissions can be immersed in the fluid under test for extended periods and at elevated temperatures to mimic in-use conditions. The samples can then be subjected to mechanical testing and/or physical measurement and compared to samples which have been exposed to other fluids or none (control samples). An increase in fluoroelastomer seal compatibility may be evidenced by one or more of for example, an increase in tensile strength, an increase in elongation at break or a reduction in volume change (swelling) compared to the control samples.

Methods for determining an improvement in copper corrosion compatibility will be known to those skilled in the art. For example, standard copper corrosion test ASTM D-130 may be used whereby copper strips are exposed to the fluid to be tested for a set period and then the copper content of the fluid is determined after the end of the test. Modifications to the ASTM D-130 test may also be used for example where the fluid temperature and exposure time are altered. An increase in copper corrosion compatibility may be evidenced by a low level of copper found in the fluid under test or by a reduction in the copper content compared to one or more control samples.

The invention will now be described by way of non-limiting example only.

EXAMPLE FM-1

Preparation of Friction Modifier

A two liter flask fitted with an overhead stirrer and a Dean Stark trap with a condenser is charged with iso-stearic acid (2 moles, 568 g) and 400 molecular weight polyethylene glycol, 'Dow Carbowax 400' (1 mole, 400 g) and 0.2 g of an esterification catalyst (p-toluene sulfonic acid). The temperature of the mixture is then raised to 190-200° C. under a nitrogen sweep and maintained for around 10 hours during which time approximately 2 moles (~35 g) of water was evolved. The mixture was then cooled to yield the product.

EXAMPLE FM-2

Preparation of Friction Modifier

Example FM-1 was repeated replacing the iso-stearic acid with oleic acid (2 moles, 568 g).

EXAMPLE FM-3

Preparation of Friction Modifier

Example FM-1 was repeated replacing the polyethylene glycol with ETHOMEEN® C-15 available from Akzo Nobel (~1 mole, 425 g). The product obtained had a nitrogen content of 2.82 wt %.

EXAMPLE FM-4

Preparation of Friction Modifier

Example FM-2 was repeated replacing the polyethylene glycol with ETHOMEEN® C-15 available from Akzo Nobel (~1 mole, 425 g). The product obtained had a nitrogen content of 2.89 wt %.

COMPARATIVE EXAMPLE CFM-1

Preparation of Friction Modifier

The procedure of Example FM-1 was repeated using tetraethylene pentamine (1 mole, 189 g) and iso-stearic acid (3.1 moles, 792 g). Approximately 3 moles of water was evolved during the course of the reaction and the final product had a nitrogen content of 6.4 wt %. CFM-1 is an example of a common type of commercial friction modifier used in automatic transmission fluids.

COMPARATIVE EXAMPLE CFM-2

Preparation of Friction Modifier

Into a one liter round-bottomed flask fitted with a mechanical stirrer, nitrogen sweep, Dean Stark trap and condenser was placed iso-octadecenylsuccinic anhydride (1 mole, 352 g). Under a slow nitrogen sweep the material was stirred and heated to 130° C. Immediately, tetraethylene pentamine (0.46 moles, 87 g) was added slowly through a dip-tube. The temperature of the mixture increased to 150° C. where it was held for 2 hours. During this heating period, 8 ml of water (~50% of theoretical yield) were collected in the trap. On completion, the flask was cooled and the product recovered. Yield: 427 g, nitrogen content: 7.2 wt %. CFM-2 is an example of a common type of commercial friction modifier used in automatic transmission fluids.

EXAMPLE D-1

Preparation of Borated PIBSA-PAM Dispersant

A polyisobutenyl succinic anhydride (PIBSA) having a succinic anhydride (SA) to polyisobutylene (PIB) mole ratio (SA:PIB) of 1.04 was prepared by heating a mixture of 100 parts by weight of PIB (940 Mn; Mw/Mn=2.5) with 13 parts by weight of maleic anhydride. When the temperature reached 120° C. 10.5 parts by weight of chlorine were added at a constant rate over a period of 5.5 hours during which time the temperature was raised to 220° C. The reaction mixture was then held at 220° C. for 1.5 hours and then stripped with nitrogen for 1 hour. The resulting PIBSA had an ASTM saponification number of 112. The product was 90 wt % active ingredient, the remainder being primarily unreacted PIB.

In a second stage, the PIBSA produced above (2180 g, ~2.1 moles) was placed in a vessel equipped with a stirrer and a nitrogen sparger together with Exxon solvent 150 neutral oil (1925 g). The mixture was stirred and heated under nitrogen to 149° C. and Dow E-100 polyamine, a mixture of ethylene polyamines with an average of 5 to 7 nitrogen atom per molecule (PAM) (200 g, ~1.0 mole) added over a period of approximately 30 minutes. After addition was complete, the mixture continued to be stirred under nitrogen for an additional 30 minutes (until no further water was evolved) before being cooled and filtered to recover the product. The product obtained had a nitrogen content of 1.56 wt %.

In a final stage, the product of the second stage above (1000 g) was placed in a vessel equipped with a stirrer and a nitrogen sparger. The material was heated to 163° C. and boric acid (19.8 g) added over a period of one hour. After addition was complete, the mixture continued to be stirred under nitrogen for an additional 2 hours minutes before being cooled and filtered to recover the product. The product obtained had a nitrogen content of 1.56 wt % and a boron content of 0.35 wt %.

EXAMPLE 1

Friction Testing

Fluids containing the friction modifiers of Examples FM-1, FM-2, FM-3 and FM-4 were tested together with similar fluids containing comparative example friction modifiers CFM-1 and CFM-2. For completeness, a fluid which did not contain a friction modifier was also tested. The compositions of the fluids tested are given in Table 1 below where "Test FM" refers to the friction modifier. Friction characteristics were evaluated using a low velocity friction apparatus. In this test, a small disc of friction material is run against a steel disc to simulate the environment in an automotive transmission clutch. The friction value determined is plotted against sliding velocity to give a friction versus velocity curve. The method can also be used to determine low speed or static friction. Further details of the test method can be found in "Prediction of Low Speed Clutch Shudder in Automatic Transmissions using the Low Velocity Friction Apparatus", R. F. Watts & R. K. Nibert, 7$^{th}$ *International Colloquium on Automotive Lubrication, Technishe Akademie Esslingen* (1990).

The role of the friction modifier in the fluid is to reduce the static friction, therefore examining the static friction of a fluid gives a good assessment of the friction reducing capability of the molecule under test.

TABLE 1

Fluids for friction testing

| Component | Function | Mass percent |
|---|---|---|
| product of Example D-1 | dispersant | 3.50 |
| tri-lauryl tri-thio phosphite | anti-wear agent | 0.50 |
| alkylated diphenyl amine | anti-oxidant | 0.50 |
| hindered phenol | anti-oxidant | 0.30 |
| tolyl triazole | corrosion inhibitor | 0.05 |
| calcium sulphonate | metal-containing detergent | 0.10 |
| polymethacrylate | viscosity modifier | 6.00 |
| 100 neutral mineral oil | base fluid | 86.05* |
| Test FM | friction modifier | 3.00 |
| | Total | 100.00 |

(*for the fluid which did not contain a friction modifier, an additional 3.00 wt % of the mineral oil was used)

Values for static friction obtained from the Low Velocity Friction apparatus are given in Table 2 below. Each test was run at 4 different test fluid temperatures.

TABLE 2

| Friction modifier | Static friction coefficient 40° C. | 80° C. | 120° C. | 150° C. |
|---|---|---|---|---|
| None | 0.203 | 0.200 | 0.186 | 0.172 |
| FM-1 | 0.100 | 0.089 | 0.085 | 0.084 |
| FM-2 | 0.123 | 0.114 | 0.102 | 0.100 |
| FM-3 | 0.103 | 0.097 | 0.095 | 0.093 |
| FM-4 | 0.085 | 0.083 | 0.088 | 0.087 |
| CFM-1 | 0.109 | 0.088 | 0.080 | 0.079 |
| CFM-2 | 0.123 | 0.113 | 0.100 | 0.094 |

From the result obtained, it can be seen that the fluid which did not contain any friction modifier gave rise to a very high static friction value. The friction modifiers which are included in the fluids of the present invention (FM-1, FM-2, FM-3 and FM-4) gave static friction values which are intermediate to the two known friction modifiers CFM-1 and CFM-2. This shows that the fluids of the invention display good friction characteristics.

EXAMPLE 2

Compatibility with Fluoroelastomers

The friction modifiers tested in Example 1 were formulated into fluids with the compositions shown in Table 3 below. As before, a 'blank' sample fluid which did not contain any friction modifier was also tested. Dumb-bell shaped specimens of a fluoroelastomer material (an FKM materials designated V-51) commonly used to manufacture seals for use in vehicle transmissions were immersed in the test fluids and held there at 150° C. for 336 hours. After immersion, the specimens were removed from the fluid and stretched until they broke. Elongation at break and tensile strength were recorded. The volume swell of each specimen was also determined. Results are present in Table 4 below.

TABLE 3

Fluids for fluoroelastomer compatibility testing

| Component | Function | Mass percent |
|---|---|---|
| product of Example D-1 | dispersant | 3.50 |
| tri-lauryl tri-thio phosphite | anti-wear agent | 0.10 |
| alkylated diphenyl amine | anti-oxidant | 0.25 |
| 4 cSt Group III base stock | base fluid | 94.15* |
| Test FM | friction modifier | 2.00 |
| Total | | 100.00 |

(*for the fluid which did not contain a friction modifier, an additional 2.00 wt % of the base stock was used)

TABLE 4

| Friction modifier | Fluoroelastomer compatibility testing Volume change (%) | Elongation at break (%) | Tensile strength at break (psi max) |
|---|---|---|---|
| None | 1.40 | 285 | 1274 |
| FM-1 | 2.09 | 300 | 1476 |
| FM-2 | 2.03 | 219 | 1090 |
| FM-3 | 2.12 | 226 | 1049 |
| FM-4 | 2.14 | 308 | 1491 |
| CFM-1 | 3.26 | 163 | 754 |
| CFM-2 | 2.98 | 152 | 719 |

The data in Table 4 clearly show that the fluid which did not contain any friction modifier performed very well. The volume change was small and the elongation at break was high, as was the ultimate tensile strength. Contrastingly, the fluids which contained the known friction modifiers performed poorly. The fluids of the present invention containing (FM-1, FM-2, FM-3 or FM-4) were much closer in performance to the 'blank' sample and in the cases of FM-1 and FM-4, they outperformed the 'blank' sample both in terms of elongation at break and tensile strength.

Overall, the testing performed confirms that fluids according to the present invention provide good friction characteristics and also show enhanced compatibility towards fluoroelastomer seals.

EXAMPLE 3

Compatibility with Copper

Two mass percent of each of FM-1, FM-2, FM-3 and FM-4 as well as the same amount of CFM-1 and CFM-2 were individually dissolved in a commercial API Group III base stock. The solutions so prepared were used in a copper dissolution test which was run according to the ASTM D-130 procedure except that the test lubricant was maintained in contact with the copper test strip at 150° C. for 24 hours. At the end of the 24 hour test a sample of each lubricant was tested using ICP spectroscopy to determine the copper content. Results are shown in Table 5 below where the amount of copper in each sample is expressed as parts per million of copper in the oil by weight.

TABLE 5

Copper dissolution - 24 hours at 150° C.

| | Friction modifier CFM-1 | CFM-2 | FM-1 | FM-2 | FM-3 | FM-4 |
|---|---|---|---|---|---|---|
| ppm, Cu | 84 | 35 | 3 | 3 | 6 | 4 |

The results show that the fluids containing FM-1, FM-2, FM-3 and FM-4 are much more compatible with copper than either fluid containing CFM-1 or CFM-2 (as evidenced by the clear reduction in copper dissolution into the fluid).

What is claimed is:

1. A power transmitting fluid comprising a major amount of a natural lubricating oil and a minor amount of an additive composition, the additive composition comprising:

(a) a friction modifier of the formula:

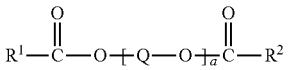

(b) an oil-soluble phosphorus compound: and (c) an ashless dispersant:

where $R^1$ and $R^2$ may be the same or different and represent linear or branched, saturated or unsaturated hydrocarbyl groups having from 8 to 20 carbon atoms;

wherein Q represents an alkylene group having 1 to 4 carbon atoms; and wherein a is an integer from 5 to 15.

2. A fluid according to claim 1 wherein Q or each Q is an ethylene group.

3. A fluid according to claim 2 wherein $R^9$ is an alkyl group.

4. A fluid according to claim 1 wherein $R^1$ and $R^2$ are the same.

5. A fluid according to claim 1 wherein $R^1$ and $R^2$ are linear or branched, saturated or unsaturated alkyl groups having from 4 to 20 carbon atoms.

6. A fluid according to claim 1 wherein the fluid further comprises one or more corrosion inhibitors.

7. A fluid according to claim 1 wherein the fluid further comprises one or more metal-containing detergents.

8. A fluid according to claim 1, which is an automatic transmission fluid.

9. A method of formulating a power transmitting fluid with improved fluoroelastomer seal compatibility, the method comprising combining a major amount of a natural lubricating oil with a minor amount of an additive composition as defined in claim 1.

10. A method of formulating a power transmitting fluid with improved copper corrosion compatibility, the method comprising combining a major amount of a lubricating oil with a minor amount of an additive composition as defined in claim 1.

* * * * *